US005506475A

United States Patent [19]

Alton

[11] Patent Number: 5,506,475

[45] Date of Patent: Apr. 9, 1996

[54] MICROWAVE ELECTRON CYCLOTRON ELECTRON RESONANCE (ECR) ION SOURCE WITH A LARGE, UNIFORMLY DISTRIBUTED, AXIALLY SYMMETRIC, ECR PLASMA VOLUME

[75] Inventor: Gerald D. Alton, Kingston, Tenn.

[73] Assignee: Martin Marietta Energy Systems, Inc., Oak Ridge, Tenn.

[21] Appl. No.: 216,230

[22] Filed: Mar. 22, 1994

[51] Int. Cl.[6] ..... H05H 1/10

[52] U.S. Cl. ..... 315/111.41; 315/111.21; 315/111.71

[58] Field of Search ..... 315/111.21, 111.31, 315/111.41, 111.71, 111.61, 111.81; 118/715, 723 R, 620, 623

[56] References Cited

U.S. PATENT DOCUMENTS

| | | | |
|---|---|---|---|
| 4,745,337 | 5/1988 | Pichot et al. | 315/111.41 |
| 4,778,561 | 10/1988 | Ghanbari | 156/643 |
| 4,891,095 | 1/1990 | Ishida et al. | 156/643 |
| 5,032,202 | 7/1991 | Tsai et al. | 156/345 |
| 5,133,826 | 7/1992 | Dandl | 156/345 |
| 5,189,446 | 2/1993 | Barnes et al. | 315/111.41 |
| 5,241,244 | 8/1993 | Cirri | 315/111.41 |

OTHER PUBLICATIONS

*Metal Ion Production In ECRIS (Invited)*, by R. Geller, P. Ludwig, and G. Melin (Presented on 4 Oct. 1991); Rev. Sci. Instrum. 63 (4) Apr. 1992, 1992 American Institute of Physics.

*Microwave Multipolar Plasma for Etching and Deposition*, by Rudolf R. Burke and Claude Pomot; Solid State Technology/Feb. 1988.

*ECR Sources for the Production of Highly Charged Ions (Invited)*, by C. M. Lyneis and T. A. Antaya (Presented on 10 Jul. 1989); Rev. Sci. Instrum. 61 (1), Jan. 1990, 1990 American Institute of Physics.

*Primary Examiner*—Robert J. Pascal

*Assistant Examiner*—David H. Vu

*Attorney, Agent, or Firm*—E. A. Pennington; J. M. Spicer; H. W. Adams

[57] ABSTRACT

An electron cyclotron resonance (ECR) ion source includes a primary mirror coil disposed coaxially around a vacuum vessel in which a plasma is induced and introducing a solenoidal ECR-producing field throughout the length of the vacuum vessel. Radial plasma confinement is provided by a multi-cusp, multi-polar permanent magnet array disposed azimuthally around the vessel and within the primary mirror coil. Axial confinement is provided either by multi-cusp permanent magnets at the opposite axial ends of the vessel, or by secondary mirror coils disposed on opposite sides of the primary coil.

17 Claims, 7 Drawing Sheets

MICROWAVE ELECTRON CYCLOTRON ELECTRON RESONANCE (ECR) ION SOURCE WITH A LARGE, UNIFORMLY DISTRIBUTED, AXIALLY SYMMETRIC, ECR PLASMA VOLUME

This invention was made with Government support under contract DE-AC05-840R21400 awarded by the U.S. Department of Energy to Martin Marietta Energy Systems, Inc. and the Government has certain rights in this invention.

FIELD OF THE INVENTION

The present invention relates generally to microwave electron cyclotron resonance (ECR) ion sources, and more specifically, to an ECR ion source that uses a B-minimum magnetic-mirror geometry which includes a multi-cusp magnetic field to assist in confining the plasma radially, a flat central field for tuning to the ECR resonant condition, and tailored mirror fields in the end zones to confine the plasma in the axial direction. The magnetic field is designed to achieve an axially symmetric plasma "volume" with constant mod-B, which extends over the length of the central field region.

BACKGROUND OF THE INVENTION

ECR plasma generating devices have been developed for use in semiconductor manufacturing processes such as chemical vapor deposition and etching.

U.S. Pat. No. 5,133,826 to Dandl describes an ECR plasma source having magnets disposed circumferentially around a cylindrical chamber to increase the plasma density. Microwave power is injected into the chamber perpendicular to the longitudinal axis of the chamber.

U.S. Pat. No. 5,241,244 to Cirri describes a plasma generating device having a confinement field and an electromagnetic field. Permanent magnets are disposed at one end of the plasma chamber, and a coil is disposed circumferentially around the chamber.

U.S. Pat. No. 4,891,095 to Ishida et al. describes a plasma generating device in which a mirror field has its field axis parallel to a specimen surface. The mirror field is supplied by a pair of electromagnets disposed on diametrically opposite sides of the reaction chamber.

U.S. Pat. No. 5,032,202 to Tsai et al. describes a plasma generating device which uses a solenoid magnet disposed on the axis of the chamber, and a plurality of permanent magnet columns disposed circumferentially to radially confine the plasma. Upper and lower ring magnets help confine the plasma in the axial direction.

U.S. Pat. No. 4,778,561 to Ghanbari describes an ECR plasma source having an electromagnet primary field source and a second field source made of circumferentially disposed permanent magnets which are axially spaced from the primary source.

In general, ECR zones in ECR ion sources are limited to regions where the magnetic field meets the ECR resonant condition, given by the following expression:

$$\omega_{ECR}=Be/m=\omega_n$$

where $\omega_{ECR}$ is the electron-cyclotron resonant angular frequency, $\omega_n$ is the resonant frequency of the microwave power source, e is the charge, and m is the mass of the electron.

Whenever the microwave frequency is tuned to the electron-cyclotron frequency, electrons can be resonantly excited and thereby given sufficient energy to cause ionization within an evacuated volume. At low collision frequencies (low ambient pressures), some of the electrons are coherently excited and given very high energies which are capable of removing tightly bound electrons and, therefore, are responsible for producing multiply ionized atoms.

In conventional ECR ion sources, tuning to the resonant condition is accomplished by adjusting the magnitude of the mirror coils, located at the ends of the ionization chamber. The geometry and design principles used in conventional ECR sources are illustrated in FIG. 1. FIG. 1 is from a publication entitled "ECR Sources For The Production Of Highly Charged Ions (Invited)" by C. M. Lyneis et al., *Rev. Sci. Instrum.* 61 (1) (Jan. 1990). In FIG. 1, the axial magnetic field corresponding to a 250 amp current in the coils is superimposed on the drawing.

This type of ECR ion source design has several inherent limitations on performance in terms of the degree of ionization (intensity) and high charge state capabilities. For one limitation, the ECR zones are limited to localized regions of the source ionization volume where the magnetic field flux density is correct for resonant excitation. These zones are small with respect to the total ionization volume and are fluted ellipsoidal surfaces which surround the axis of symmetry where the ions are extracted from the source. The ECR surfaces shift in position whenever the magnetic field is adjusted.

For another limitation, because of the small physical size of the ECR zones in relation to the total ionization volume and the fact that only electrons within this zone are excited, electrons within most of the plasma volume are not excited. As a consequence, the "hot" zones are very small compared to the "cold" zones within the chamber. The "cold" zones are filled with lower-charge-state and neutral atoms. Multiply charged ions, created by "hot" electrons, undergo resonant or perhaps non-resonant charge exchange during collisions with like neutral or lower-charge-state species more frequently in the "cold" zones because of the higher population of these species in these zones. This process results in much lower average charge states and degree of ionization than could be achieved if the ECR zones filled most of the cavity (The resonant charge exchange process has the characteristic feature that the cross section is maximum at zero center of mass energies). Non-resonant charge exchange processes (collisions between unlike species) also occur which further reduce the average charge state and degree of ionization within the source.

The effect of reducing the probability of charge exchange as a consequence of increasing the ECR zone would be to increase the residence time of an ion species in a particular charge state, thereby increasing the probability of further ionization of the species. Thus, incorporation of a large ECR zone would be desirable for high-charge-state sources, as well as high-intensity, low-charge-state ion source applications. Since the "hot" zones lie off the optical axis or axis of symmetry of the source, ions must always pass through extended "cold" zones of the source prior to extraction. Furthermore, an extended "cold" zone occurs at the extraction end of the source. The consequences of this design limit the capabilities of the ECR ion source in terms of intensity and charge state distribution.

Because high ECR ion sources work at low pressures ($1\times10^{-6}$ Torr, typically), the amount of microwave power that can be coupled into the plasma is limited. This results in a saturation effect which is often observed experimentally.

The amount of power could be increased by increasing the ECR hot zone in relation to the total ionization volume of the source. The result would be to increase the hot zones, thereby increasing the degree of ionization and, as a consequence, reducing the resonant charge exchange processes.

As a further limitation of the conventional sources, those of the type depicted in FIG. 1 are erroneously said to perform better in terms of charge-state distribution whenever the RF excitation frequency is increased (R. Geller, IEEE Trans. Nucl. Sci. CH2669-0, 1088 (1989)). This finding is attributable to the effect produced by increasing the magnetic field strength of the mirror coils which, increases the confinement times of particles in the plasma. In order to maintain a constant position of the ECR zone, higher frequency power sources are required; this observation is, therefore, not a fundamental attribute of the RF frequency. The advantages of using higher frequency microwave power sources lie in the higher plasma densities that can be achieved without cutoff problems. The consequence of increasing the magnetic field is to increase the containment time of a particle in a particular charge state, thereby increasing the charge state distribution from the source. The penalties paid for increasing the magnetic field are higher power requirements and, consequently, power costs for operating the source. Typical sources require up to 5,000 Gauss fields and use 14 GHz microwave power sources.

Emittance brightness degradation is a further limitation of the conventional ECR devices. The emittances of conventional ECR ion sources are, generally, higher than other positive ion sources due to two effects; both effects are caused by the very strong mirror fields used to confine the plasma in the axial direction. Ions are extracted across strongly graded and radially directed magnetic fields, which results in emittance degradation due to conservation of angular momentum and due to the non-linear coupling of longitudinal momentum to the transverse directions of motion. These effects increase the phase space (emittance) $\epsilon$ approximately proportional to $\Delta\epsilon\alpha Br^2$ Thus, lower emittances can be effected by reducing the magnetic field strength in the main volume of the source and in the extraction regions of the source. Emittance degeneration can be reduced by using a relatively low RF frequency power source for plasma ignition and maintenance while providing magnetic shields to shield the ions during extraction from the effects of the strong mirror fields in the extraction region of the source.

SUMMARY OF THE INVENTION

An object of the present invention is to provide an ECR ion source capable of operating with a low-cost microwave power source of, for example, 2.45 GHz, and requiring a relatively low magnetic field of, for example, 875 Gauss.

Another object of the present invention is to provide an ECR ion source that incorporates a large ECR "volume," symmetrically distributed about the axis of symmetry where the ions are extracted, with independently controlled mirror fields for axial plasma confinement and central magnetic field for tuning to the ECR resonant condition.

Another object of the present invention is to provide an ECR ion source with improved emittance by shielding ions from the effects of the radially directed, strong mirror magnetic fields used to effectively confine the plasma in the axial direction, but which degrade the emittance through non-linear coupling of the longitudinal and transverse directions of motion of the ions during extraction.

Further objects of the present invention include providing an ECR source that exhibits higher degrees of ionization for low-charge-state applications, higher charge state distributions for heavy multiply charged ion source applications, superior beam properties (lower emittances), lower power consumption, and large uniform plasma density distribution which is compatible with plasma etching and other plasma processing applications of large area semiconducting materials.

These and other objects of the invention are met by providing an electron cyclotron resonance (ECR) ion source which includes a vacuum vessel having a longitudinal axis, inlet means for introducing a processing gas into the vacuum vessel or an oven or other means for introducing solid material, extractor means for removing an ion beam from the vacuum vessel, first field generator means, disposed coaxially around the vacuum vessel, for introducing a solenoidal ECR-producing field throughout the length of the vacuum vessel, second field generator means, at least partially disposed coaxially within the first field generator means, for introducing a plasma confinement field into the vacuum vessel, and means for introducing microwave energy into the vacuum vessel at a level sufficient to produce a plasma within the vacuum vessel.

Other objects, advantages and salient features of the invention will become apparent from the following detailed description, which taken in conjunction with the annexed drawings, discloses preferred embodiments of the invention.

DETAILED DESCRIPTION OF THE INVENTION

Figure 2:
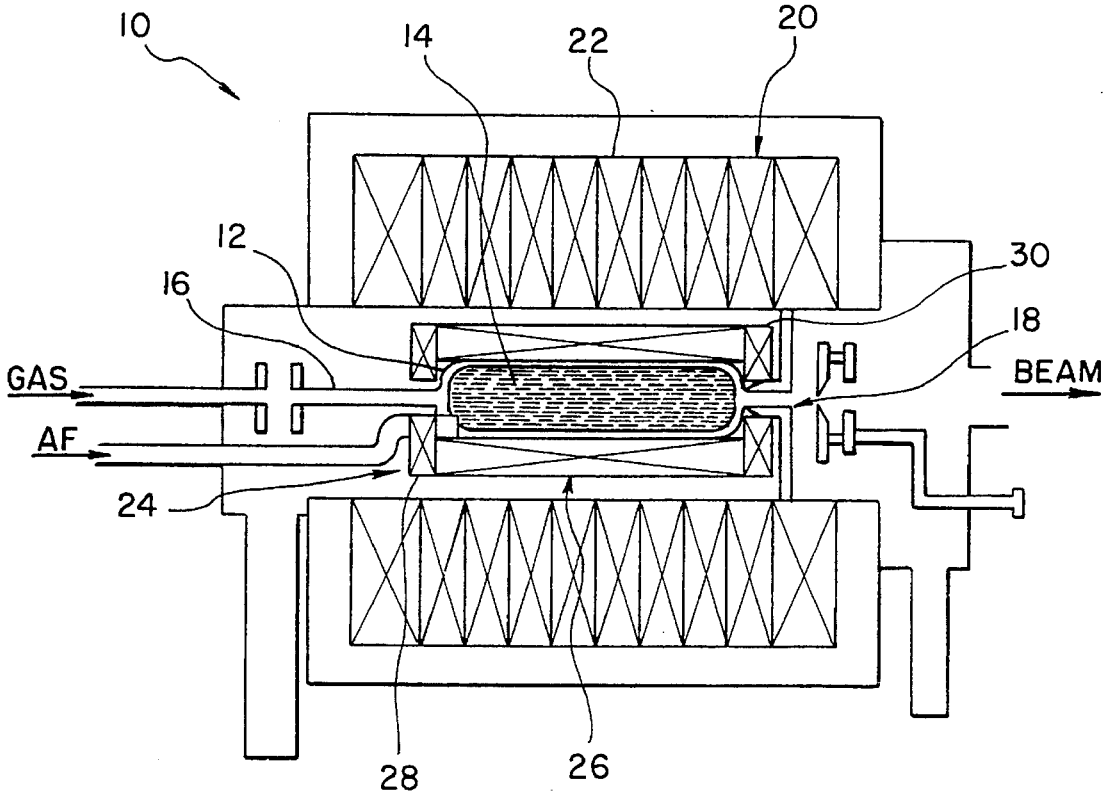
FIG. 2 is a schematic vertical cross sectional view of an ECR ion source according to a first, preferred embodiment of the present invention.

Referring to FIG. 2, an ECR ion source 10 includes a vacuum vessel 12 which provides containment for a plasma 14. The vessel 12 an elongated cylinder having a longitudinal axis, and first and second opposite axial ends.

A quartz tube 16 provides means for introducing a gas into the first axial end of the vessel 12, while an outlet or extraction means 18 is provided at the second axial end for removing an ion beam. The gas is selected depending on the type of ion beam desired, which in turn is determined by the desired use of the ion source. Gas feed materials are used for purposes of illustration only. The design of the invention does not preclude the use of ovens, solid rods, or foils for injecting solid, condensable materials for ionization as is done in conventional ECR ion sources.

First magnetic field generating means 20 is provided coaxially around the vessel 12 to provide a homogeneous solenoidal field for tuning to the ECR condition. The first field generating means 20 is preferably a primary coil or solenoidal coil 22 which extends the length of the vessel 12.

Figure 1:
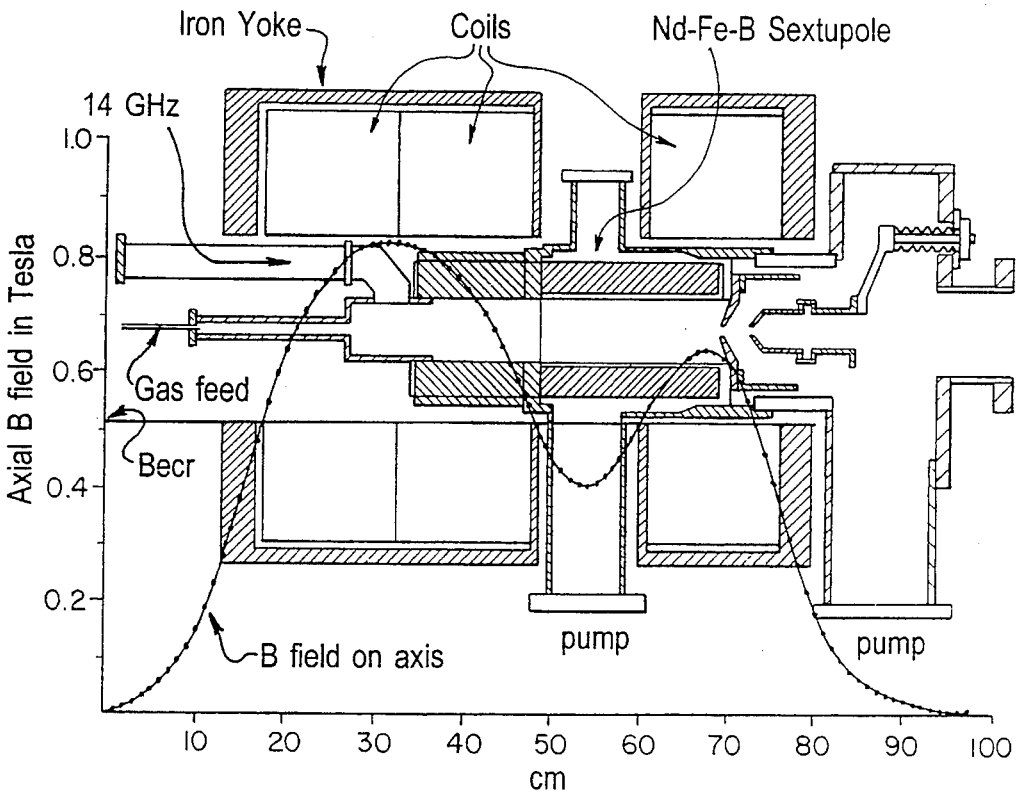
FIG. 1 (PRIOR ART)
FIG. 1 is a schematic vertical cross sectional view of a known ion source having its axial magnetic field superimposed thereon.
Figure 3:
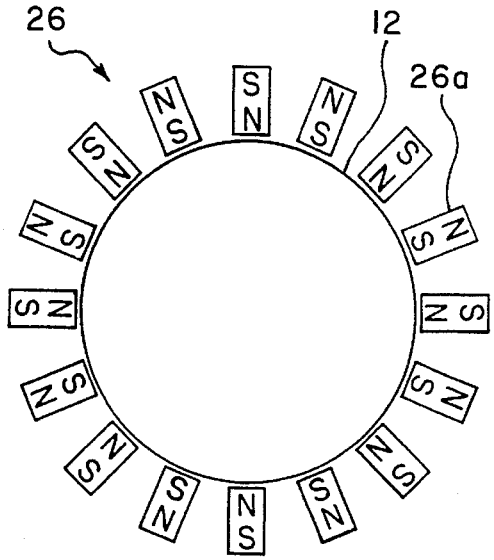
FIG. 3 is an end view of the vacuum vessel of FIG. 2 and radial plasma confinement magnets.

Second magnetic field generating means 24 provide axial and radial confinement of the plasma 14. The second field generating means 24 includes radial confinement means 26 which includes a plurality of permanent magnets 26*a* (FIG. 3) disposed around the periphery of the vessel 12 to form a multiple pole, multi-cusp magnetic field. In general, N must be an even number and can be chosen between N=4 and N=24. N=24 is considered the practical upper limit because there is little gain in the ECR volume by choosing larger values. While larger N values correlate to larger ECR zones, N can be varied, depending on the choice of the design engineer. However, the choice of a large N value is not a prerequisite condition in order to utilize the benefits of the invention. The fundamental importance of the invention not only lies in the ability to extend the ECR zone radially, but in the fact that it extends along the full length of the plasma chamber, and of equal importance, it is symmetrically distributed about the axis of symmetry where the ions are extracted. Thus, for any choice of N within the previously mentioned range of values, the resultant ECR ion source will have a much larger and more appropriately positioned ECR zone than would a conventional ECR ion source, such as shown in FIG. 1, and therefore, be superior in performance. An arrangement of N=16 magnets is shown in FIG. 3 for illustrative purposes. The poles of each of sixteen adjacent magnets 26*a* alternate north and south, as shown in FIG. 3.

Figure 4:
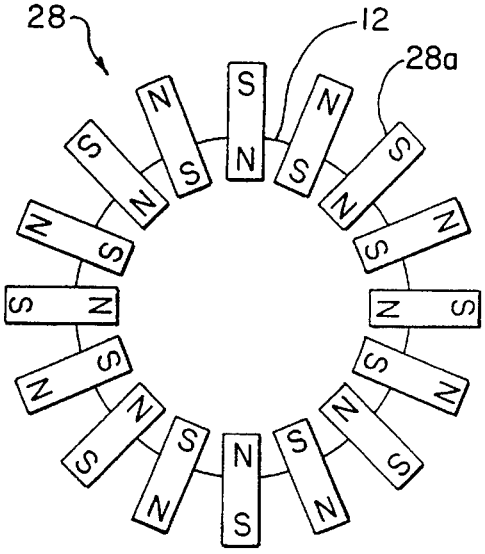
FIG. 4 is an end view of the vacuum vessel of FIG. 2 and one set of axial confinement magnets.

The second field generating means 24 further includes axial confinement means 28 and 30, each comprising multipole, multi-cusp permanent magnets. FIG. 4 shows the individual magnets 28*a* of the first end confinement means 28. As in the radial confinement magnets, N can be chosen between N=4 and N=24. Sixteen magnets are used in the illustrated embodiment, but higher or lower numbers can be employed.

Figure 5:
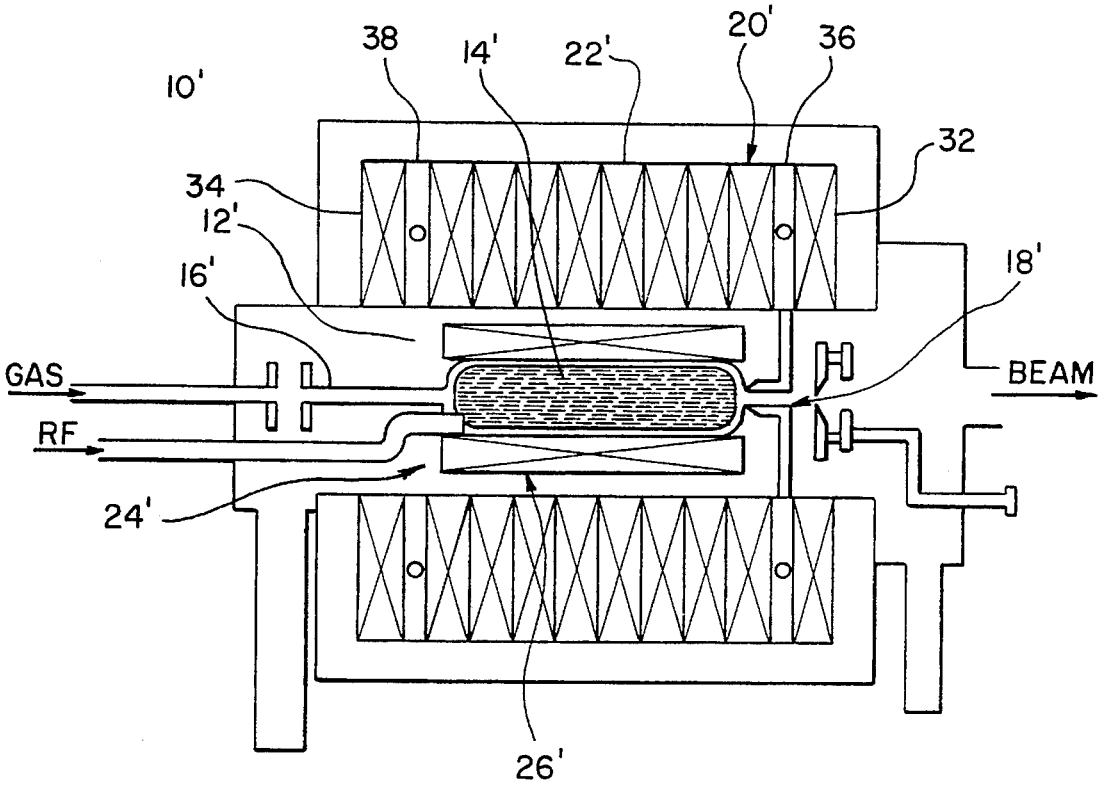
FIG. 5 is a schematic vertical cross sectional view of an ECR ion source according to a second, preferred embodiment of the present invention.

An alternative embodiment is illustrated in FIG. 5, wherein like reference numerals, but primed, are used to refer to like parts. In this embodiment, multipolar permanent magnets 26' are used to effect radial plasma confinement as in the previous embodiment. However, instead of using a multi-cusp field to effect axial plasma confinement, highly tailored mirror magnetic fields are used. These fields are established by first and second opposite end mirror coils 32 and 34.

Both embodiments use a homogeneous solenoidal control field for tuning to the ECR condition. The mirror fields, generated by mirror coils 32 and 34, are tailored so that the tune solenoidal field is continuous and flat over the plasma volume of the source. While permanent magnets are used for the multi-cusp fields, either electromagnetic or permanent magnets could be used for the solenoidal magnetic fields.

The combined axial and multi-cusp magnetic fields are disposed to be homogeneous in the radial and axial directions where the resonant ionization volume is located. The solenoidal field, generated by coils 20 and 20', is used to tune to the resonant frequency for heating electrons distributed over a large ECR resonant volume to high energies capable of multiple ionization of heavy atoms trapped within the magnetic field volume.

The energy source for plasma generation and maintenance in the two source concepts is ECR heating of the plasma electrons. The energy (electron temperature), energy distribution (temperature distribution) and electron population are three of the fundamental properties which govern the performance of the ion source in terms of degree of ionization and multiple ionization capabilities of the source. The embodiments described herein thus provide a relatively large resonant volume, which permits the heating of electrons to higher energies over a much larger volume of the plasma discharge than is possible in more conventional ECR ion sources. The consequence of this is to produce a much higher degree of ionization and higher charge state distribution than possible in other known ion sources.

In order to achieve a flat field profile in the radial direction, the present invention encompasses the ability to use a high-order multi-cusp magnetic field. Where N is the number of cusps, then the radial behavior of the magnetic field is proportional to $r^{N/2-1}$, where r is the radial coordinate.

Figure 6A:
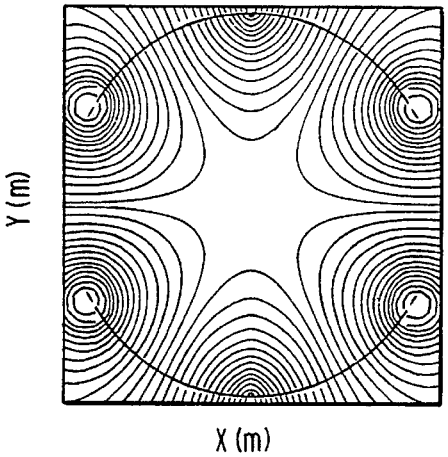
FIGS. 6*a* and 6*b* are magnetic field lines and field magnitudes, respectively, for radial plasma confinement using a multi-cusp permanent magnet arrangement with six cusps.
Figure 6B:
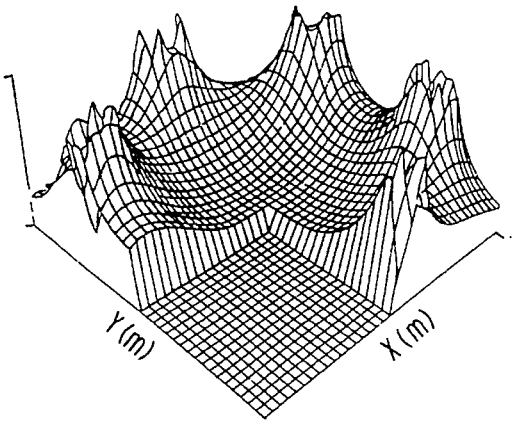
Figure 6C:
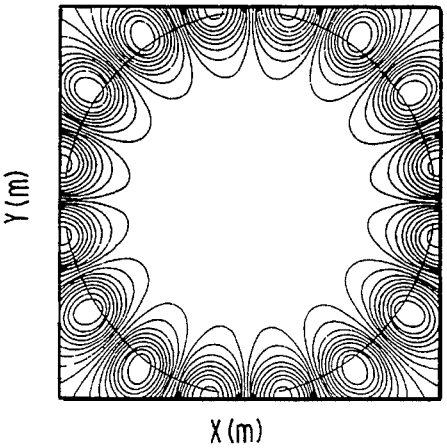
FIGS. 6*c* and 6*d* are magnetic field lines and field magnitudes, respectively, for radial plasma confinement using a multi-cusp permanent magnet arrangement with sixteen cusps.
Figure 6D:
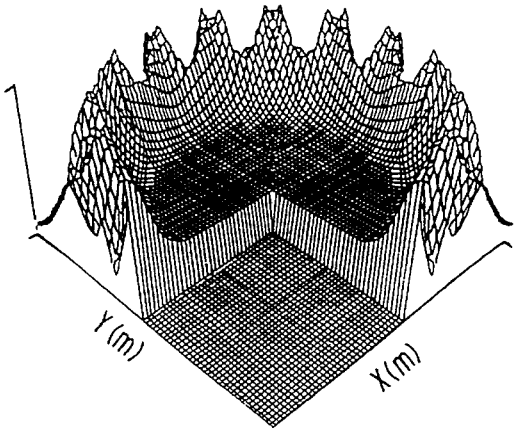

FIGS. 6*a* and 6*b* are magnetic field lines and field magnitudes, respectively, for radial plasma confinement using a multi-cusp permanent magnet arrangement with six cusps, while FIGS. 6*c* and 6*d* are magnetic field lines and field magnitudes, respectively, for radial plasma confinement using a multi-cusp permanent magnet arrangement with sixteen cusps. Many standard ECR ion sources typically use a six cusp (six pole) arrangement. As is apparent from the field lines and intensities, as the multiplicity of the field increases, the radial field becomes flatter. Flatter fields lead to larger ECR zones.

Figure 7:
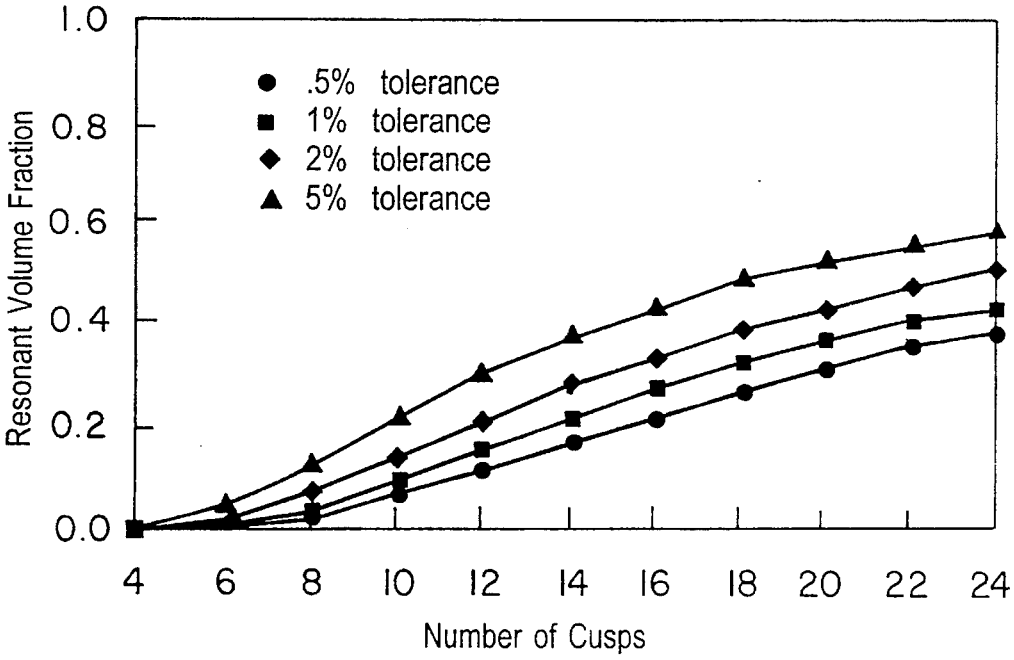
FIG. 7 shows the fraction of the volume which is at the ECR condition within a specified tolerance.

FIG. 7 shows the fraction of the volume which is at the ECR condition within a specified tolerance. For example, if the multiplicity is twenty-four (N=24), then the resonant volume is 60% of the total volume. In a source equipped sextupole ECR ion source with a uniform, flat solenoidal field, the ECR zone is less than 4% of the total volume. However, in both cases, the ECR zone is symmetrically located about the axis of symmetry and extends the full length of the plasma volume.

Note that in conventional sources the ECR zones do not lie on-axis and do not have "volume" ECR zones but are thin ECR "surfaces" which lie about the axis.

The maximum electron temperature is affected by several processes, including the ability of the plasma to absorb ECR power, the time required to produce heated electrons, the time for thermalization of the "hot" electrons, and the ability to contain (confine) the "hot" electrons.

The magnetic-field geometry and magnetic-field strength determine the confinement attributes of an ECR ion source. The arrangement of field generators according to the present invention yields ion sources that have superior properties in each of the aforementioned fundamentally important areas.

In prior art ECR ion sources, electrons gain energy in the very small ECR zones which are off axis and located near the ends of the device. Electrons produce further ionization in the bulk of the plasma, or non-resonant volume, after leaving the ECR zone. They cannot be further heated in the non-resonant or "cold" zones of the source and lose their energy or thermalize during collisions with the electrons, atoms, and ions within the non-resonant plasma volume. Because the ECR zones constitute a small fraction of the ionization volume of the sources, absorptivity of the plasma is determined not by the physical size of the plasma volume, but by the size of the ECR zones. As a consequence, the degree of ionization and high charge state populations of the prior art sources are considerably lower than possible in the sources of the present invention. The lack of ability to heat electrons in the bulk of the plasma creates a cold zone where the average charge state and degree of ionization are lower. Resonant charge exchange collisions between ions reduce the degree of ionization and high charge state population of the source.

The present invention allows for heating of a large fraction of the total volume of the source. A high order multi-cusp-field design for confining the plasma in the radial direction is instrumental in providing a larger resonant volume at a constant ECR magnetic field. The tune magnetic field is effected by adjusting the uniformly distributed solenoidal field.

One of the benefits of the ECR ion source of the present invention, which uses multi-cusp fields to confine the plasma in the axial direction, is the fact that the magnetic field from the cusp field magnets is zero on axis. This allows one to use weaker mirror fields in the end zones to extend the ECR resonance volume and to assist in confining the plasma in the axial direction, which makes magnetic shielding easier of the solenoidal and mirror magnetic fields in the extraction region of the source; the consequence of using these magnets is to appreciably-reduce non-linear coupling effects previously discussed which degrade the emittance of ion beams extracted from the source.

The FIG. 5 embodiment, using highly tailored axial mirrors which are more effective for confining the plasma, is easier to construct. The volume within the mirror coil 32 and near the extraction region of the device 10' is made field free by magnetic shielding to reduce emittance degradation.

Both embodiments consist of a deep minimum B configuration with a large volume of uniform magnetic field, delivered by coils 20 and 20', in the central region of the source. Because the field in the central region is uniform, the ECR condition can be tuned to be resonant with the bulk volume of the plasma rather than with the very localized, off-axis ECR zones near the ends of the device, typical of conventional ECR ion sources. Thus, while conventional ECR ion sources are non-resonant in the central volume of the plasma chamber and resonant only in very thin and small ECR zones near the ends of the device, the ECR ion sources of the present invention are resonant over the central magnetic field region and end zones of the plasma chamber. Consequently, there is a much larger volume of resonant plasma, resulting in greater absorptivity of the microwave power. The ECR zones are on axis and commensurate for extraction of highly ionized ions. These features of the source result in significantly greater interaction of the ECR microwaves with the plasma electrons, both in terms of total power absorptivity and in a more uniform spatial distribution of the absorptivity. The more uniform distribution of the ECR power and the greater proportion of hot electrons, as a consequence, implies a greater degree of ionization of the plasma and higher charge states of multiply charged ions within the plasma volume. The ability to ionize a large fraction of the plasma volume effectively reduces the resonant charge exchange electron transfer between neutral and ionized atoms, thereby increasing the residence time of an ion in a given charge state, which increases the probability for subsequent and further ionization. Thus, a greater degree of ionization results in a higher charge state distribution.

Both embodiments described herein use uniform solenoidal magnetic field coils 20 and 20' for tuning to the ECR condition and a high order multi-cusp permanent magnet arrangement for confining the plasma 14 and 14' in the radial direction. The device of FIG. 2 uses multi-cusp magnetic fields located at the ends of vessels 12 and 12', while the embodiment of FIG. 5 uses tailored mirror magnetic field-generating coils 32 and 34. Both types of end zone fields are designed to confine the plasma in the axial direction. The tailored mirror field geometry is simpler and less costly to effect, while the multi-cusp field geometry is less likely to contaminate the emittance of the ion beam during extraction. In order to avoid emittance degradation during extraction, a tailored magnetic shield is preferably incorporated in the mirror geometry source. Either embodiment can be configured for room temperature operation or provided with a cryostat for operation in superconducting mode. The later mode is commensurate with high magnetic fields which are desirable for containment of high energy electrons required for producing high charge state heavy ions. The superconducting mode is also desirable from the standpoint of power conservation. An ideal geometry would include a superconducting electromagnetic multi-cusp field for radial confinement and tune to the ECR condition with the homogeneous solenoidal field.

The mirror magnetic field-producing coils 32 and 34 of the FIG. 5 embodiment are preferably solenoid fields superposed on the ends of the corresponding central solenoidal field coils 20 and 20', respectively. The end zone mirror coils 32 and 34 are tailored so that the central field remains flat whenever the mirror fields are adjusted to higher or lower values. The method used to tailor the mirror fields so that the axial field remains flat is illustrated in FIG. 8.

Figure 8:
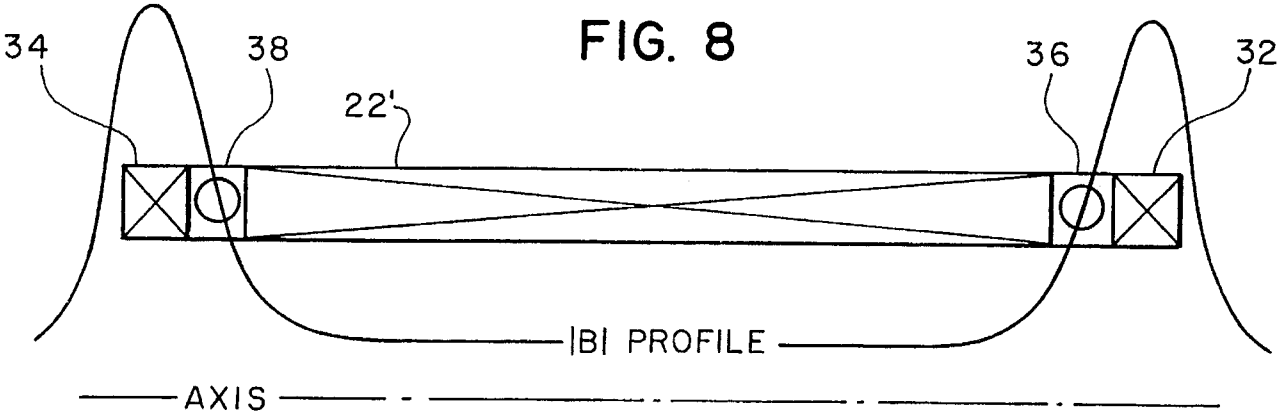
FIG. 8 is an enlarged, schematic view of half the mirror coil/trim coil arrangement for the embodiment of FIG. 5.
Figure 10:
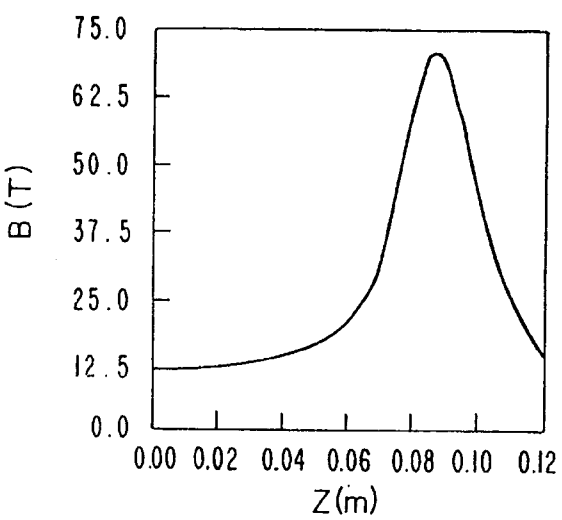
FIGS. 9 and 10 are axial field and profile graphs using mirror and trim coils, as a function of axial position Z.
Figure 9:
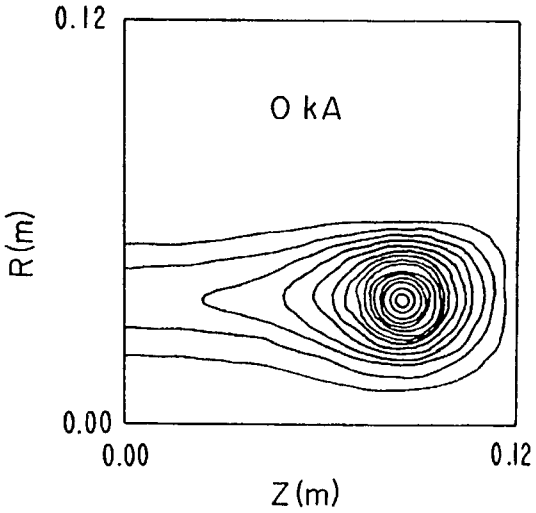
Figure 12:
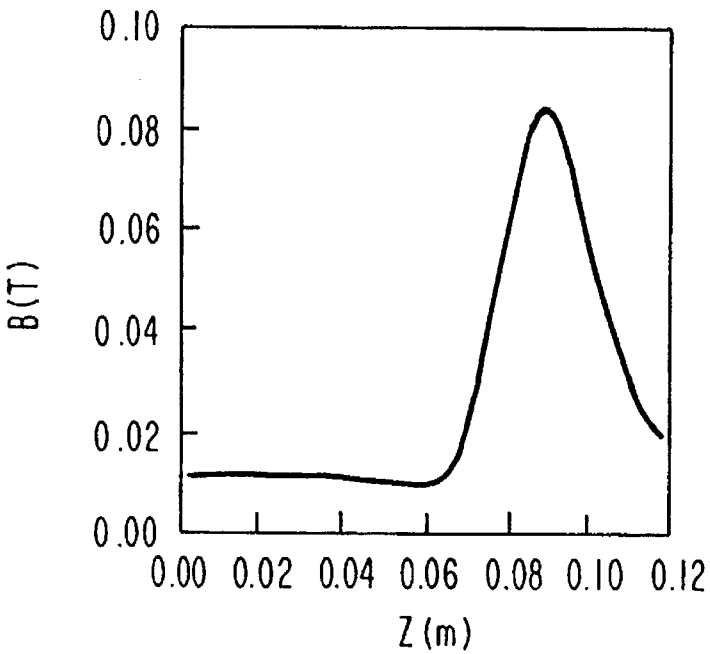
FIGS. 11 and 12 are axial field and profile graphs using mirror and trim coils, as a function of axial position Z, at a different excitation current from FIGS. 9 and 10.
Figure 11:
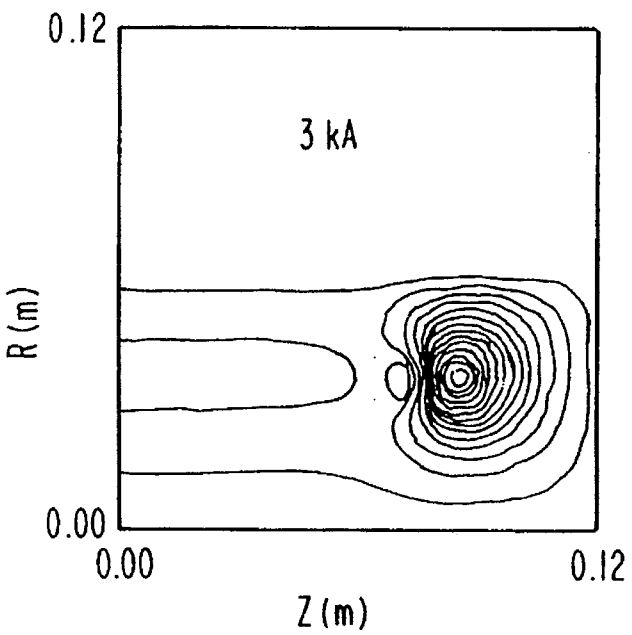

As seen in FIGS. 5 and 8, trim coils 36 and 38 are respectively disposed inside the mirror coils 32 and 34, respectively. The trim coil magnetic fields are positioned so that their magnetic field cancel the tails of the main mirror coils, which are parabolic and would otherwise spoil the flat axial field required to maintain the homogeneous axial field used to tune to the ECR condition. The coil design of FIG. 8 is for a plasma stripper axial magnetic field. The illustration shows relative locations of the main, mirror and trim coils with respect to each other and to the longitudinal axis of the vessel. Also illustrated is the magnetic field magnitude to show the effect of the trim coils in providing a flat central field region.

FIGS. 9–12 illustrate the concept which display magnetic field lines and the axial magnetic flux density as a function of axial position Z for various excitation currents in the trim coils. The main solenoidal coil is activated with 2 kA turns while the mirror coils are activated with 3 kA turns. The objective of the design is to achieve a flat solenoidal field, and thus, specific values can be determined on a case by case basis.

The central solenoidal field used in the present invention can be tuned to the ECR condition independently of the fields used to confine the plasma in the radial and axial directions. The multi-cusp and mirror magnetic fields are thus adjusted independently for purposes of radial and axial plasma confinement. These functions are typically coupled in the conventional ECR sources. For example, in conventional ECR ion sources, it is observed that higher charge states result whenever the mirror magnetic fields are increased significantly. This phenomenon is almost certainly attributable to an increase in the confinement times for "hot" electrons, which are responsible for producing multiply-charged ions and not a fundamental attribute of the RF frequency as erroneously postulated. The use of higher mirror fields to enhance confinement times necessarily requires higher frequency power sources to match the ECR resonant condition $\omega_{ECR}$=Be/m if the ECR zones are maintained at the same position in the source. High-frequency power supplies are often very expensive. The higher magnetic fields increase the power and, consequently, the expense of operation. The present invention can operate at lower frequencies, e.g., 2.45 GHz, which are, in general, relatively inexpensive.

Figure 13:
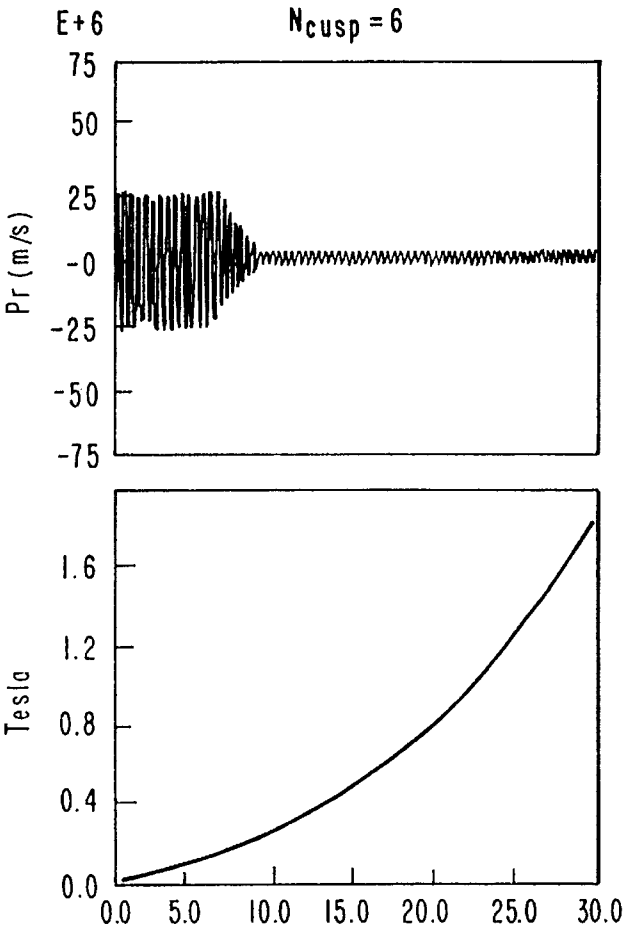
FIG. 13 shows magnetic field intensity versus radial position (lower graph) and electron velocity versus radial position (upper graph) for a six cusp radial confinement.
Figure 14:
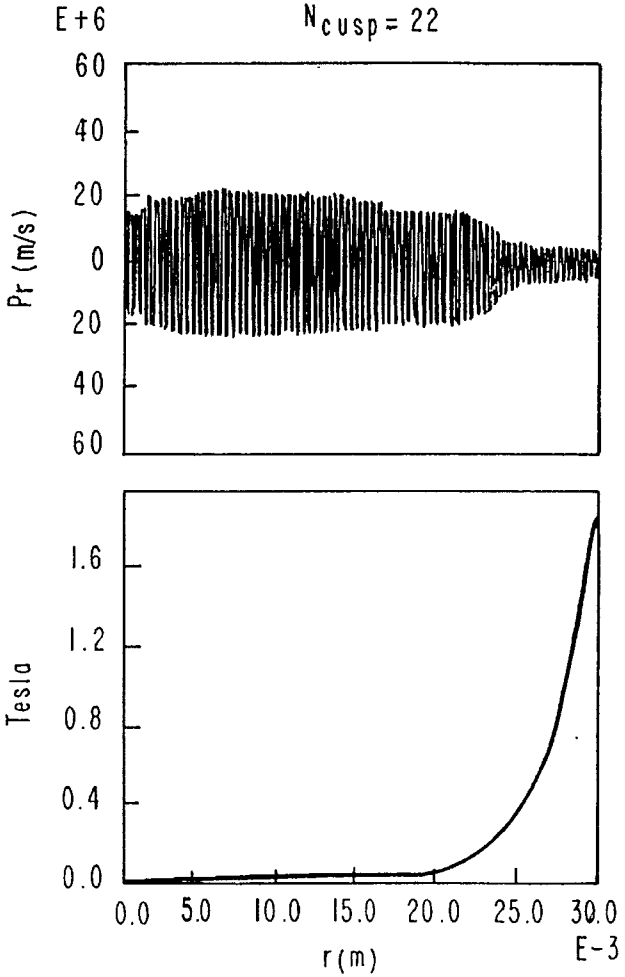
FIG. 14 shows magnetic field intensity versus radial position (lower graph) and electron velocity versus radial position (upper graph) for a twenty-two cusp radial confinement.

FIGS. 13 and 14 further illustrate the fact that higher numbers of cusps produce a flatter field in the radial direction. FIG. 13 shows magnetic field intensity versus radial position (in the lower graph) and electron velocity versus radial position (in the upper graph) for a six cusp radial confinement. FIG. 14 are the same views for a twenty-two cusp arrangement. The physical volume of the ECR zone is thus increased through a flattening of the radial magnetic field. The effect of increasing the field multiplicity on the physical size of their respective ECR zones for the two multipole fields is illustrated by the upper portions of FIGS. 13 and 14 which display, respectively, the velocity of the electrons as a function of radial position and thus illustrate the heating of electrons by microwave power adsorption at the ECR frequency.

The results displayed in the upper portions of FIGS. 13 and 14 were obtained by using particle-in-cell (PIC) codes which calculate the transfer of microwave energy to electrons at the ECR condition. The heating effect or adsorption of microwave power is only possible at the ECR condition which is set by the solenoidal magnetic field, $\omega_{ECR}$=Be/m.

In FIGS. 13 and 14, the transition from heated to non-heated regions of the plasma at the ECR condition is apparent. The lower order multiple field (N=6) results in a smaller volume of hot electrons, and therefore, the ECR volume of a hexapole field is smaller. The hot zones in conventional sources, e.g., the sources of the type shown in FIG. 1, are even smaller because they only occur at specific radial positions because of the curvature of the magnetic field. The zones which fall outside the hot electron zones would be cold and filled with neutral and low-charge-state ions. In effect, the hot zones feed the cold zones and vice versa. The effect then is to reduce the degree of ionization and the high charge state component of the heavy ion population.

PIC simulation runs have shown that the point of injection of the rf power in the axial direction is off-axis. On axis injection tends to cause reflection back toward the power source. The reflection is apparently caused by the abrupt change in the index of refraction in the wave guide port of unity to the very low value of the plasma. The reflection problem was obviated by injecting the rf power near the outer radius of the non-resonant plasma volume where the plasma density is lower. However, the present invention does not preclude the use of other RF injection schemes and therefore, does not restrict itself, exclusively, to the off-axis, axial RF power injection scheme described above; for example, the RF power may also be injected in the radial direction without reflection problems.

In other embodiments, the mirror coil embodiment could act as the first stage of two stages in which the first stage plasma would be allowed to expand into a second stage for meeting the uniformity and large-area requirements as required for the plasma processing of large-diameter (up to 203 mm) semiconducting material wafers. The second stage would then be provided with its own weak solenoidal tune field, rf power source, and high-order multiple field for radial confinement. The length of the device and radial extent of both source geometries can be varied as required for the particular application. For operation in the so-called cavity mode, the radial and longitudinal dimensions should be precisely calculated to be integral multiples of the wave length of the eigenfrequency. However, in practice, the RF power is much more difficult to couple into such precisely dimensioned cavities which give rise to reflection and/or cutoff problems during RF injection. In practice, it is preferable to make the cavity larger than the wave length of the RF radiation to avoid such problems; the cavity is then said to be a multi-mode cavity. In the geometries proposed, the plasma chamber (cavity) would be optimized by use of PIC codes to operate in multi-mode. For large area applications such as required for processing silicon wafers with diameters greater than or equal to 203 mm, a two-stage system may be desirable which has independently controllable high-order multiple and solenoidal fields. The second stage of the source for this application must be much larger in diameter to achieve the uniformity required.

The present invention can be used for low and high energy ion implantation applications; high-intensity, multiply charged ion beams for high-energy, heavy-ion, accelerator-based research applications; plasma processing of semiconducting materials; isotope separation; MHD thrusters for space travel; and others.

While advantageous embodiments have been chosen to illustrate the invention, it will be understood by those skilled in the art that various changes and modifications can be made therein without departing from the scope of the invention as defined in the appended claims.

What is claimed is:

1. An electron cyclotron resonance (ECR) ion source comprising:

a vacuum vessel in which a plasma is induced;

inlet means for introducing a processing material into the vacuum vessel;

extractor means for removing an ion beam from the vacuum vessel;

first field generating means, disposed coaxially around the vacuum vessel, for introducing a solenoidal ECR-producing field throughout a length of the vacuum vessel;

second field generating means, at least partially disposed coaxially within the first field generating means, for introducing a plasma confinement field into the vacuum vessel, wherein the second field generating means includes axial plasma confinement means and radial plasma confinement means, the axial plasma confinement means comprises first and second mirror coils disposed respectively at opposite axially ends of the first field generating means; and means for introducing microwave energy into the vacuum vessel at a level sufficient to produce the plasma within the vacuum vessel.

2. An electron cyclotron resonance (ECR) ion source according to claim 1, wherein the introducing means comprises a waveguide disposed off the longitudinal axis of the vacuum vessel.

3. An electron cyclotron resonance (ECR) ion source according to claim 1, wherein the first field generating means comprises a central field primary coil extending substantially the length of the vacuum vessel.

4. An electron cyclotron resonance (ECR) ion source according to claim 1, wherein the first and second field generating means are independently tunable.

5. An electron cyclotron resonance (ECR) ion source according to claim 1, wherein the axial and radial plasma confinement means are independently tunable.

6. An electron cyclotron resonance (ECR) ion source according to claim 1, wherein the radial plasma confinement means comprises a plurality of radially disposed permanent magnets positioned azimuthally at spaced intervals around the vacuum vessel, with alternating poles forming multi-pole, multi-cusp magnetic confinement field.

7. An electron cyclotron resonance (ECR) ion source according to claim 6, wherein the number of radially disposed permanent magnets comprising the axial plasma confinement means is between 4 and 24.

8. An electron cyclotron resonance (ECR) ion source according to claim 1, wherein the introducing means is connectable to a relatively low frequency power source.

9. An electron cyclotron resonance (ECR) ion source according to claim 1, wherein the axial plasma confinement means comprises a plurality of axially disposed permanent magnets positioned at opposite ends of the vacuum vessel, with alternating poles forming a multi-pole, multi-cusp magnetic confinement field at each opposite end of the vacuum vessel.

10. An electron cyclotron resonance (ECR) ion source according to claim 9, wherein the number of axially disposed permanent magnets comprising the axial plasma confinement means at each opposite end of the vacuum vessel is between 4 and 24.

11. An electron cyclotron resonance (ECR) ion source according to claim 1, wherein first and second mirror coils respectively include first and second trim coil means for flattening the magnetic field at the opposite axial ends of the vacuum vessel.

12. An electron cyclotron resonance (ECR) ion source comprising:

a vacuum vessel in which a plasma is induced;

inlet means for introducing a processing gas into the vacuum vessel;

extractor means for removing an ion beam from the vacuum vessel;

a primary coil extending substantially the length of the vacuum vessel, and being disposed coaxially around the vacuum vessel, and being adapted to introduce a solenoidal ECR-producing field throughout a length of the vacuum vessel;

a plurality of radially disposed permanent magnets positioned azimuthally at spaced intervals around the vacuum vessel, with alternating poles forming multi-pole, multi-cusp magnetic radial plasma confinement field;

magnetic field generating means for generating a magnetic force capable of causing axial confinement of the plasma, wherein the magnetic field generating means comprises first and second mirror coils disposed respectively at opposite axially ends of the primary mirror coil; and means for introducing microwave energy into the vacuum vessel at a level sufficient to produce the plasma within the vacuum vessel.

13. An electron cyclotron resonance (ECR) ion source according to claim 12, wherein the number of radially disposed permanent magnets is between 4 and 24.

14. An electron cyclotron resonance (ECR) ion source according to claim 12, wherein the introducing means is connectable to a relatively low frequency power source.

15. An electron cyclotron resonance (ECR) ion source according to claim 12, wherein the magnetic field generating means comprises a plurality of axially disposed permanent magnets positioned at opposite ends of the vacuum vessel, with alternating poles forming a multi-pole, multi-cusp magnetic confinement field at each opposite end of the vacuum vessel.

16. An electron cyclotron resonance (ECR) ion source according to claim 15, wherein the number of axially disposed permanent magnets at each opposite end of the vacuum vessel is between 4 and 24.

17. An electron cyclotron resonance (ECR) ion source according to claim 12, wherein first and second mirror coils respectively include first and second trim coil means for flattening the magnetic field at the opposite axial ends of the vacuum vessel.

* * * * *